US006213664B1

(12) United States Patent
Kondo

(10) Patent No.: US 6,213,664 B1
(45) Date of Patent: Apr. 10, 2001

(54) CARD MARKING DEVICE

(76) Inventor: Diane E. Kondo, 2850 Sunnyglen Rd., Torrance, CA (US) 90505

( * ) Notice: Subject to any disclaimer, the term of this patent is extended or adjusted under 35 U.S.C. 154(b) by 0 days.

(21) Appl. No.: 09/596,038

(22) Filed: Jun. 15, 2000

(51) Int. Cl.[7] ..... B43K 5/00
(52) U.S. Cl. ..... 401/205; 401/263
(58) Field of Search ..... 401/205, 196, 401/261, 263, 264, 265, 266, 206

(56) References Cited

U.S. PATENT DOCUMENTS 2,742,660 * 4/1956 Esley ..... 401/205
3,261,515 * 7/1966 Luedtke ..... 401/205
4,925,327 * 5/1990 Wirt ..... 401/205
4,961,661 * 10/1990 Sutton et al. ..... 401/205

* cited by examiner

*Primary Examiner*—David J. Walczak
(74) *Attorney, Agent, or Firm*—William H. Pavitt, Jr.; David A. Belasco; Robert Jacobs

(57) ABSTRACT

A marking instrument comprising a tubular holder having its lower end capped by an ink containing pad of a predetermined geometrical shape and disposed at an acute angle relative to the tubular axis. The pad may be removable from the tubular holder for replacement by another pad of the same or different geometrical configuration. The tubular holder may contain a quantity of marking ink which may be released to flow to the pad by the valve means.

5 Claims, 4 Drawing Sheets

Fig. 3
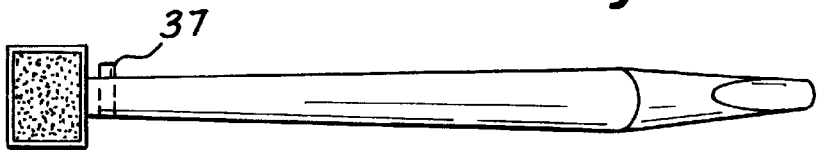
Fig. 3A
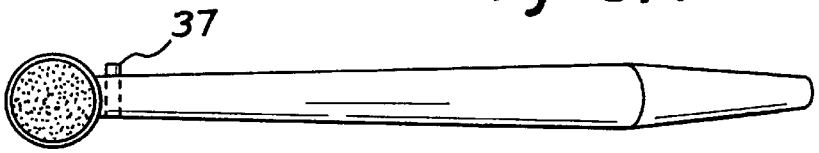
Fig. 4
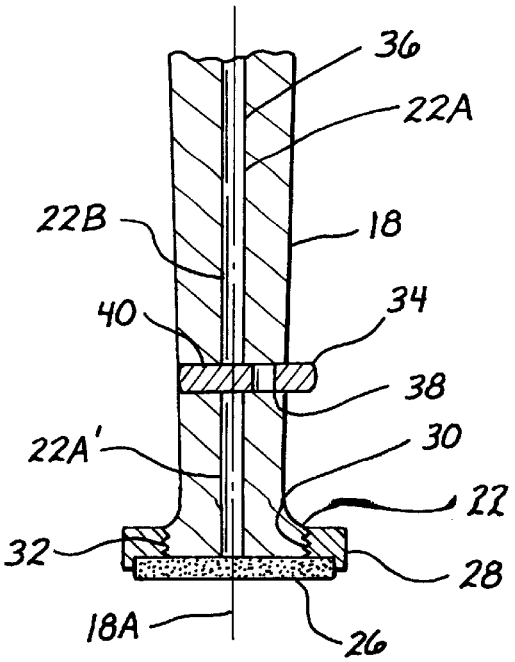
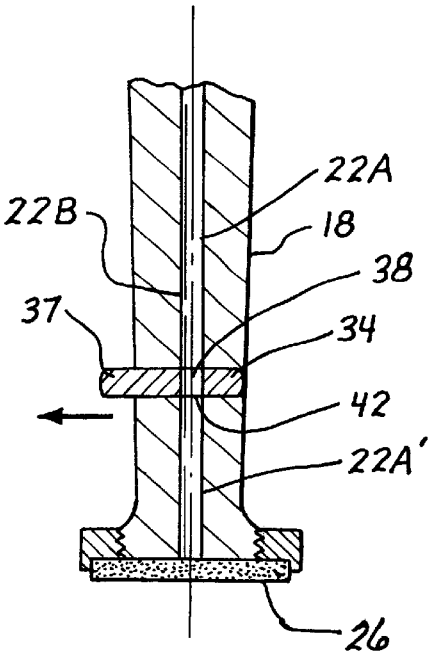
Fig. 4A

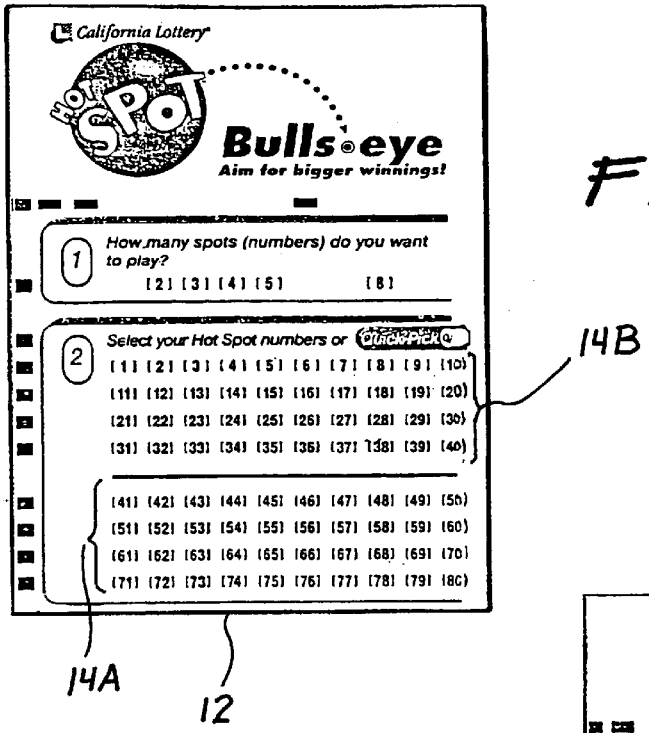
Fig. A-2
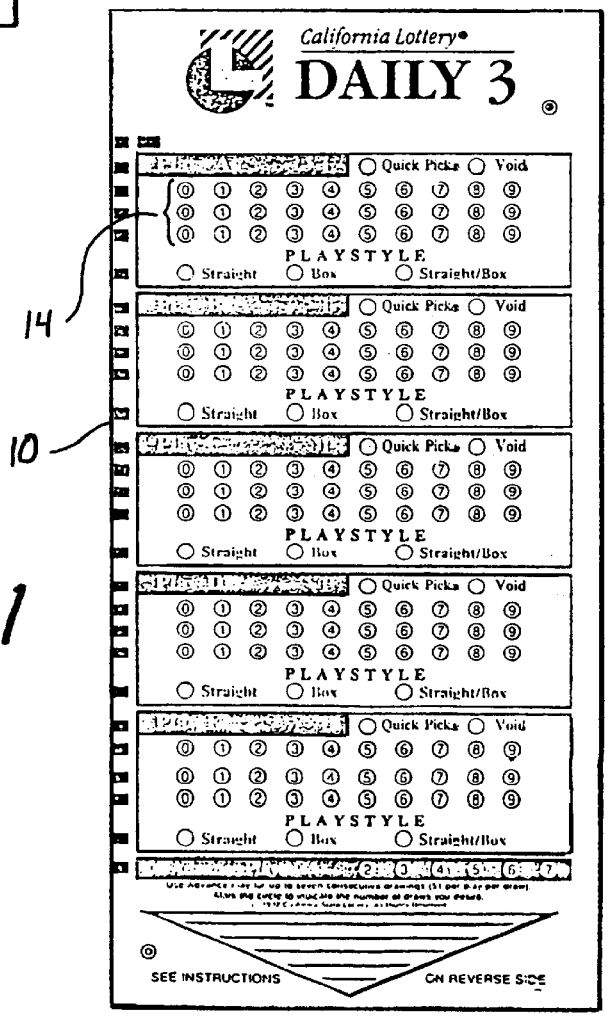
Fig. A-1

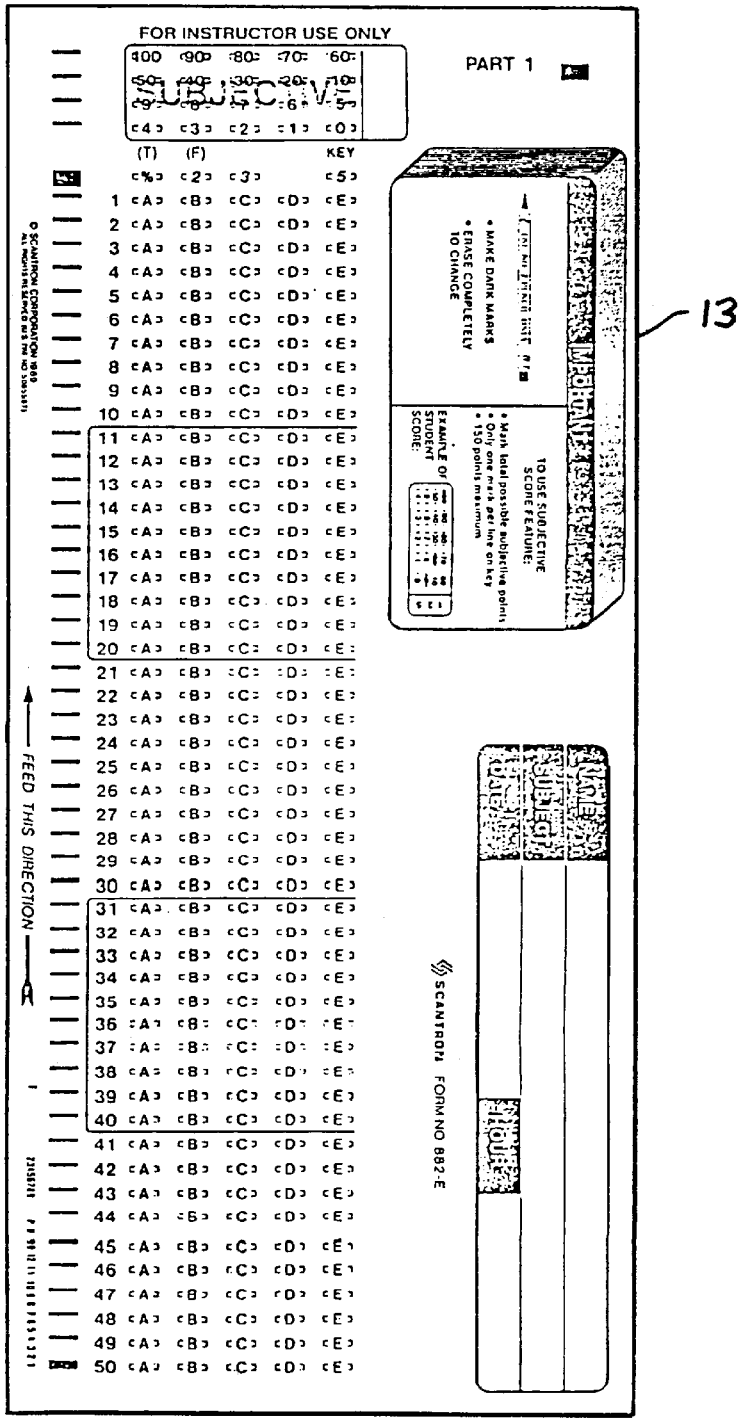
Fig. A-3

CARD MARKING DEVICE

FIELD OF THE INVENTION

This invention relates to the field of instruments for marking cards or paper in certain geometric patterns with specific application to marking lottery cards, examination questionnaires and surveys.

BACKGROUND OF THE INVENTION

Paper and card marking instruments, if writing pens and pencils are counted, have been devised and utilized from biblical times onward. Over the past century, commonly used quill pens were replaced by various types of fountain pens and ball point pens. In addition, lead pencils were developed and have been utilized since they were developed in the 1800's.

While such pens and pencils have been useful for writing and various types of marking purposes, because they are pointed, where one must mark an area with a geometric shape such as a circle, square, rectangle, or triangle, it is necessary for the user to scratch up and down, cross-ways or circularly in order to fill in an area on a card or paper which may require such a geometric marking. This may not only require some effort but, if the pen point is sharp, it could result in damaging the surface of the card or paper through scratching.

While for many years such inconvenience and possible damage to a card or paper was probably an insignificant problem, with computer readings of questionnaires, surveys, and lottery cards, the inconvenience of having to fill in even small geometric areas, on a card or paper, and the possibility of the areas being scratched by a sharp pen or pencil have become of great concern to many persons, particularly in view of the relatively recent popularity of various types of lotteries.

While various types of stamping markers have been devised, such as those illustrated and described in U.S. Pat. Nos. 3,045,593, 3,051,956, 4,452,142 and 4,649,820, such markers have been in the form of vertical elements which must be carefully aligned and then pressed down onto the area to be marked. It is usually difficult however, when looking down onto the card or paper to be marked to properly align the vertical marking pads exactly with the space to be marked—particularly where the spaces are small and disposed together. In addition, such prior art markers, because of their mechanisms, have been expensive.

SUMMARY OF THE INVENTION

The various problems encountered with prior marking devices, as described above, are obviated by the present invention which is constructed of an elongated tubular element, closed or closable at its upper end, and terminating at its lower end in a pad of a shape and area which corresponds with that to be marked, but is disposed at an acute angle to the axis of the tube.

The pad may be carried on the outer face of a small cap which, itself is disposed at the acute angle relative to the axis of the tube. Thereby, when the tube is held by the fingers of the person's hand in the manner of a writing pen or pencil, the user may see to place the pad on the exact location of the spot to be marked and when the pad has been dampened with ink-type fluid and is pressed down onto the card or paper surface, an effective mark may be made on the exact spot and without the necessity of moving the marker back and forth or from one side to another on the card or paper. The pad carrying cap may be removable from the end of the tube and replaced by a cap carrying a pad of a different geometrical shape. Thus, the pad marking could be varied between square, rectangular, triangular or circular.

The instrument itself may be constructed as a hollow pen or pencil to provide an axially extending reservoir which may be either in continuous communication with the marking pad for a limited use period, or preferably communication between the reservoir may be interdictable by valve means. The reservoir may be refillable at the upper end of the tube, when upper end comprises a removable cap or closure. Alternatively, the pad carrying cap may be removable to provide direct access to the reservoir for filling at the lower end of the tube.

In order to prevent the reservoir from being in constant communication with the pad from which evaporation of the ink type fluid may occur, it may also be desirable to provide some type of valve means to interdict communication between the lower end of the reservoir through a passage to the pad. Such a valve means may be in the form of a slideable element which may be disposed in an orifice which is transverse to the reservoir. This element may be provided with a lateral opening through it so that, when the element is moved in its orifice to dispose its opening coaxially with the tube reservoir, the fluid reservoir would be placed in communication with the dispensing pad. However, when the pad is sufficiently saturated to make the various markings, the valve means would be disposed in its blocking or interdictory position. The valve means could be biased into the latter position by a spring, or in the interest of reducing the cost of the manufacture of the device, the slideable element could be simply fitted sufficiently tightly within the tube orifice so that it would remain in whichever position it had last been pushed into.

It is also a feature of the present invention to configure the upper end of the instrument whether removable or not, as a scraper for use in those instances where a sharp edge may be called for in order to remove a plastic or other skintight overlay covering a number or word or other character of some significance. The upper end could also be formed to provide a mark removing capability, e.g. blotting or erasing.

DESCRIPTION OF THE DRAWING

In the accompanying drawings,

FIG. A1 is form of a lottery card for the marking of which the present invention is particularly useful.

FIG. A2 is another form of lottery card for the marking of which the present invention may also be effectively utilized.

FIG. A3 is a form of an examination card which may be effectively marked by an instrument of the present invention.

Figure 1:
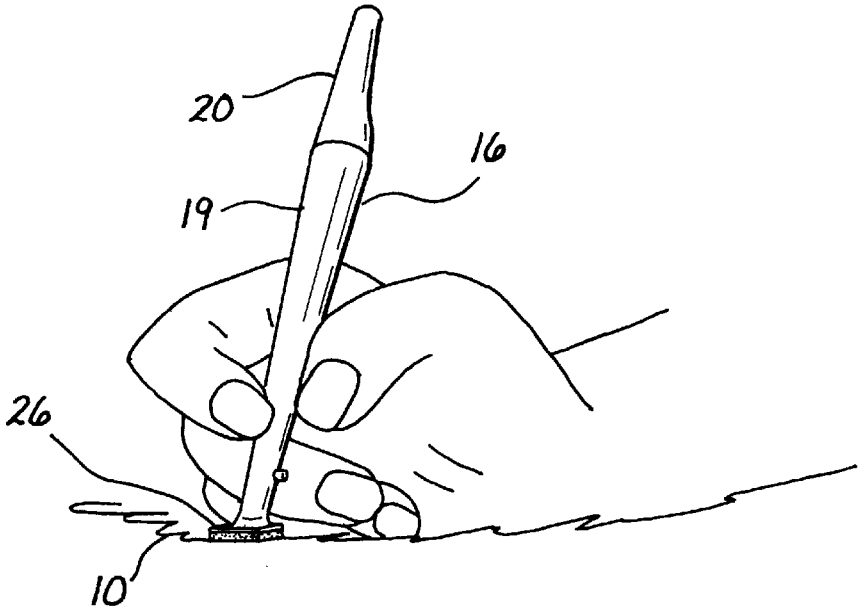

FIG. 1 is a perspective view illustrating the manner in which the device of the present invention may be utilized.

Figure 2:
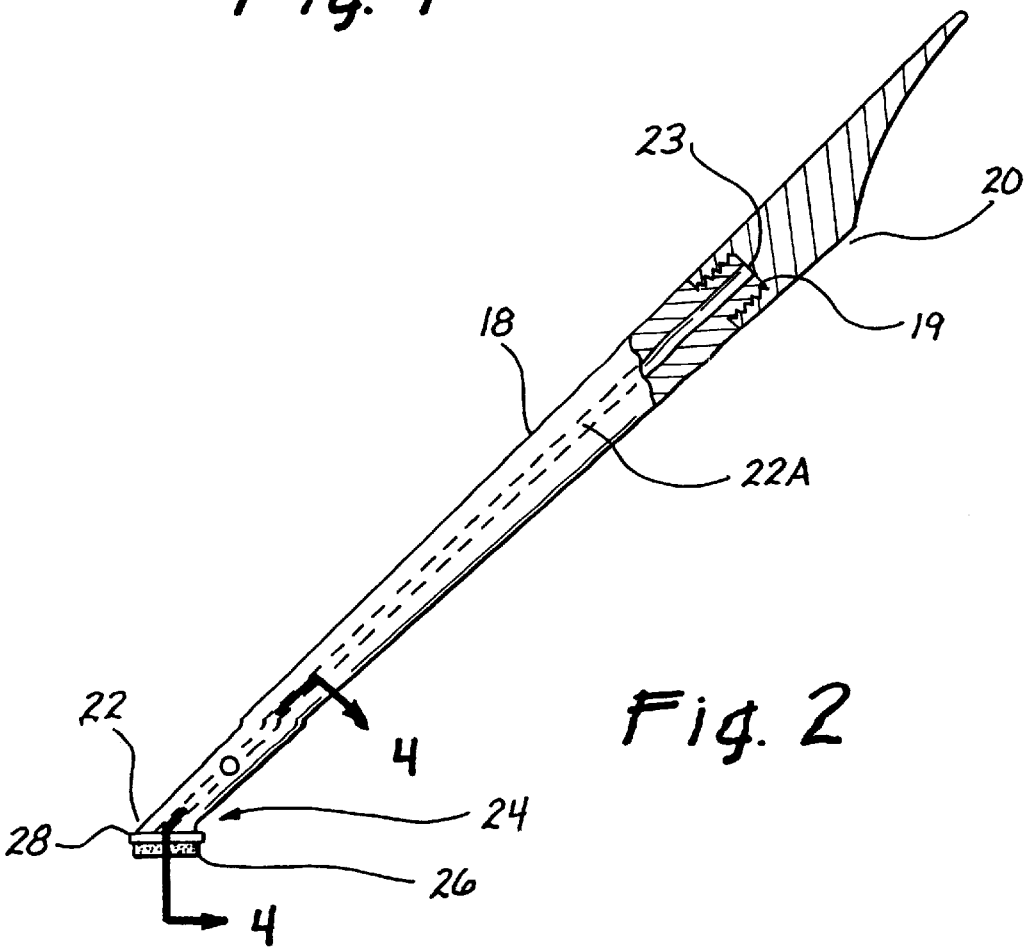

FIG. 2 is a side elevation partly in section showing one form of a marking device of the present invention.

FIG. 3 is a view of the underside of the instrument shown in FIG. 2.

FIG. 3A is a view of the underside of a different ended instrument from that of FIGS. 2 and 3.

FIG. 4 is an enlarged section taken along the line 44 of FIG. 2 showing the pin type valve in its blocking position, and FIG. 4A is a sectional view similar to that shown in FIG. 4 showing the valve pin in open position.

DESCRIPTION OF THE PREFERRED EMBODIMENT.

The present invention has been devised to enable a person to mark lottery cards 10, 12 of the types shown in FIGS. A1 and A2 or examination or survey cards shown in FIG. A3. As is well understood, such cards may include rows 14, 14A, 14B of numbers, selected ones of which must be marked by the lottery patron prior to submitting the card to an official lottery station; or, in the case of card A3, to the examining authority. As will also be appreciated, heretofore the marking of selected numbers has been accomplished by using a pencil or pen with some type of point. In order to properly mark selected numbers, the patron places the pencil point or pen tip on a selected number 14, 14A, 14B and wiggles the point or tip around over the number to fill in a numbered circle as shown in FIG. A1, or where the bracket of the number is shown in FIG. A2. This not only takes time but also requires some dexterity in order to completely fill in one of the circles 14 or a bracket 14A or 14B. In accomplishing this marking, unless care is exercised, one can cause the pencil point or pen tip to stray out of the circle 14 or bracket 14A, 14B. In addition, if the pencil point or pen tip is extremely sharp, there is always the possibility that the person marking the card 10, 12 or 13 may scratch the surface being marked to the point where the marking may not show clearly and/or the card or paper may be punctured.

There are these disadvantages of prior marking methods are avoided by the instrument 16 shown in use in FIG. 1. This comprises a thin elongated tubular member 18 having a first end 19 which may be closed by a removable cap 20, and a second open opposite end 22. An end of the cup 20 may be shaped along its upper portion as a scrape blade 19A best shown in FIG. 3. The tubular member 18 defines an inner passage 22A which extends between the capped first end 19 and the open end 22. It is contemplated that the passage 22A would be filled with a suitable marking ink. This filling can be accomplished by unthreading the removable cap 20 from the first end 19 of the tubular member 18 and pouring ink fluid 36 into the upper end 23 of the passage 22A, and then rethreading the cap 20 on the end 19.

The second end 22 terminates at an acute angle 24, preferably one between 45° and 60°, which end is capped by an absorbent or other type of transmigratory pad 26 which may be retained by a removable carrier 28. To effect such removability the end 22 of the tube 18 may be outwardly threaded at 30 (FIGS. 4, 4A) to receive internal threading 32 of the carrier 28. While the upper threaded portion of the carrier 28 must be circular in order for it to be mounted on the external threading 30 of the tube end 22, the downwardly directed face of the carrier 28 may define the different geometrical configurations, such as a circle, a triangle, a square or other rectangle. Should it be desired to use the marking device with a square, rectangular or circular pattern, the carrier face may be made accordingly to receive a stamping pad 26 of any such configuration. Thus, desirably, for the end 22 of the basic tube 18, a plurality of different carriers 28 each holding a different shaped pad 26 could be provided. It would thus be possible for the user to change the pad configuration by simply unthreading the carrier 28 from the tube end 22, and replacing it with a carrier 28 having a different and more suitable pad configuration.

While it would be possible to practice the present invention by providing a passageway 22A in constant communication with the pad 26, and by filling the passageway 22 at the first end 19 of the tube 18 whenever the pad 26 becomes dry, the frequency of such fillings may be greatly reduced by providing a valve 34 to interdict the flow of fluid 36 from the reservoir passage 22A down to the pad 26. This valve 34 may be a simple pin 37 having a transverse orifice 38 which pin is slidable back and forth in an opening 40 in the tube 18, which opening 40 is transverse to the tube axis 18A. When the pin 37 is slid in the opening 40 to dispose its orifice 38 in alignment with the axis 18*a* of the tube 18, the opening 38 will be coaligned with the passageway 22A, thereby permitting the ink fluid 36 to flow down the passage segment 22A and into the pad 26 as shown in FIG. 4A Otherwise, as shown in FIG. 4, the passage of ink fluid 36 from the upper segment 22B of the passageway 22 is interdicted.

In use, after the reservoir 22 in the tube 18 has been filled with suitable ink-like fluid 36, the user first pushes the pin 37 into the position in the tube 18 which is shown in FIG. 4A so the fluid 36 flows through the segment 22A, of the passageway 22A to saturate the pad 26. Thereupon, the user grasps the instrument 16 in the manner of using a pen or pencil as shown in FIG. 1 and presses the angled pad 26 onto selected circles 14 or brackets 14A, 14B in the cards of FIGS. A1, A2 or A3, respectively.

Should the pad 26 appear to be approaching excessive saturation, the pin 37 should be shifted to its position shown in FIG. 4, whereby further flow of fluid 26 from the reservoir segment 22A, to the pad 26 is interdicted. The FIG. 4 disposition should be maintained until the pad 26 begins to cease making marks of the desired density, whereupon the pin 37 may be shifted back to the FIG. 4 disposition.

The present invention also could be adapted to mark a chart or card with an erasable graphite type fluid, in which embodiment the cap could be headed with an eraser (not shown) so that any card marking could be erased. This embodiment might be useful where multiple choice examination questions are to be marked and the student, upon reflection, wishes to change a marking which he had previously made.

It may thus be seen that the present invention provides an effective instrument for marking cards or papers having rows of circles or brackets, selected ones of which are to be marked with an ink-type fluid. Because the marker assumes the angle at which a person would normally dispose a pen or pencil when writing, and at that angle, the person may readily see the exact location of the circle or bracket to be marked, rapid accurate marking may be readily accomplished. This feature of the present invention will be greatly appreciated by those persons who are confronted with numerous marking requirements and desire to accomplish the same accurately with a minimum expenditure of time.

I claim:

1. In combination, a card marking device and a card having at least one spot of a predetermined configuration and size to be inked when desired by the user, said device comprising a thin elongated reservoir tube having an axis and first and second ends, the first end of said tube having removable closure means whereby said first end may be closed to prevent any liquid disposed in the tube reservoir from exuding from said first tube end, but upon removal of the closure means, the tube reservoir may be filled with an ink type liquid; the second end of the tube being open to permit liquid in the tube reservoir to exude out of said second end; said second end being capped by a carrier, said carrier encompassing an upper portion of a transmigatory planar and pad presenting a lower portion of said pad of said predetermined configuration and size, and said carrier providing an orifice to afford communication between the pad and the lower portion of said tube reservoir and said pad being disposed at an acute angle relative to the axis of the tube.

2. The card marking device as described in claim 1 which is further provided with valve means disposed adjacent to the second end of the tube, said valve means being manually operable to be shifted from a first position in which communication between the tube reservoir and the pad is blocked, and a second position in which such communication is unblocked so that liquid in the tube reservoir may flow into the pad, said valve means being normally disposed in its first position.

3. The card marking device as described in claim 2 wherein the first closed end of the tube is configured as a scraper blade.

4. The card marking device as described in claim 1 wherein the second end of the tube is outwardly threaded and the upper portion of the carrier is internally threaded to engage said outward threading on the second end of the tube, thereby permitting removal of the carrier from the second end of the tube to substitute a carrier having a pad of a different size and/or configuration than that of said predetermined size and configuration.

5. The card marking device as described in claim 1 wherein the removable closure means for the first end is configured in part as a scraper blade.

* * * * *